United States Patent [19]

Van Auken et al.

[11] 4,082,277

[45] Apr. 4, 1978

[54] GOLF CLUB SHAFT

[76] Inventors: Richard L. Van Auken, Bridgewater; Allwyn W. Pirtle, S. Plainfield, both of N.J.

[21] Appl. No.: 711,284

[22] Filed: Aug. 3, 1976

[51] Int. Cl.[2] ..... A63B 53/10

[52] U.S. Cl. ..... 273/80 R; 273/DIG. 7; 273/DIG. 23; 428/36; 156/185

[58] Field of Search ..... 273/77 R, 80 R, 80 B, 273/73 F, 80.9, DIG. 7, DIG. 23; 43/18 GF; 428/36, 408, 364, 367, 368, 377

[56] References Cited

U.S. PATENT DOCUMENTS

| | | | |
|---|---|---|---|
| 2,726,185 | 12/1955 | Howald | 273/DIG. 7 |
| 2,822,175 | 2/1958 | Redmond | 273/80 B X |
| 3,166,319 | 1/1965 | Brilhart | 273/DIG. 7 |
| 3,203,849 | 8/1965 | Katz et al. | 428/408 X |
| 3,260,010 | 7/1966 | Dubois | 43/18 GF |
| 3,313,541 | 4/1967 | Benkoczy et al. | 273/80 R |
| 3,393,918 | 7/1968 | Styka | 273/73 F X |
| 3,476,625 | 11/1969 | Slivinsky et al. | 273/73 F X |
| 3,646,610 | 2/1972 | Jackson | 273/80 R |
| 3,691,000 | 9/1972 | Kalnin | 273/DIG. 7 |
| 3,969,557 | 7/1976 | Jenks | 428/36 |
| 3,969,557 | 7/1976 | Jenks | 273/80 R X |
| 3,974,012 | 8/1976 | Hogarth | 428/36 X |
| 3,998,458 | 12/1976 | Inoue et al. | 273/80 R |
| 4,000,896 | 1/1977 | Lauraitis | 273/80 R |
| 4,023,801 | 5/1977 | VanAuken | 273/80 B |
| 4,043,074 | 8/1977 | Airhart | 43/18 GF |

FOREIGN PATENT DOCUMENTS

| | | | |
|---|---|---|---|
| 1,500,344 | 9/1967 | France | 43/18 GF |
| 1,184,145 | 12/1964 | Germany | 43/18 GF |
| 378,295 | 8/1932 | United Kingdom | 273/80 R |
| 555,027 | 7/1943 | United Kingdom | 273/80 R |
| 1,261,541 | 1/1972 | United Kingdom | 273/80 R |

*Primary Examiner*—Richard J. Apley
*Attorney, Agent, or Firm*—Joseph J. Dvorak

[57] ABSTRACT

A novel golf shaft having a metal core and a graphite fiber reinforced sheath thereon is provided. The shaft has a predetermined orientation of the graphite fibers. In one embodiment, some longitudinal fibers are located in the region where the butt section of the shaft begins to taper downwardly thereby lowering the bending profile of the shaft compared with a shaft not having the longitudinal fibers. The method of fabricating the shaft also is disclosed.

10 Claims, 12 Drawing Figures

10
12
14
15
20
22
24
26
28
29
30
32
34
36
37
38
60
θ

Fig. 7.
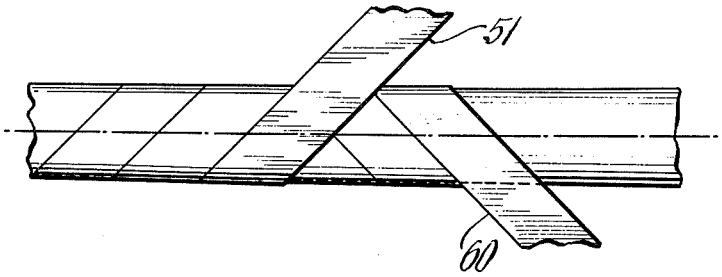
Fig. 8.
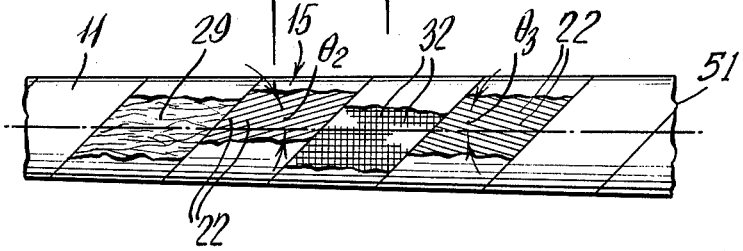
Fig. 9.
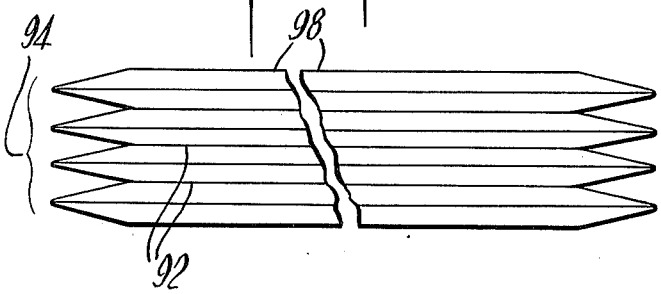
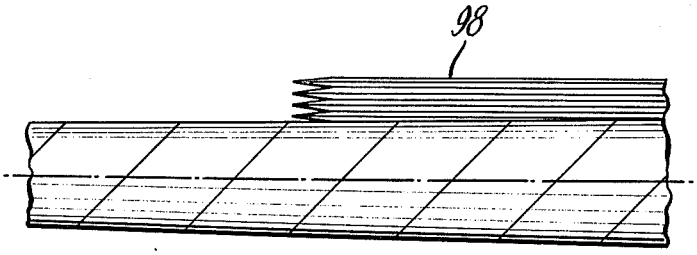
Fig. 10.
Fig. 11.
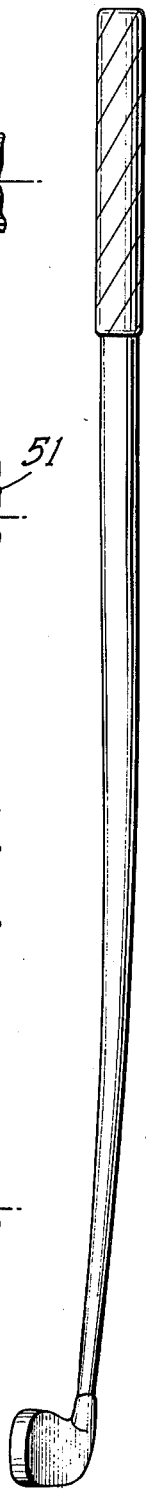
Fig. 12.
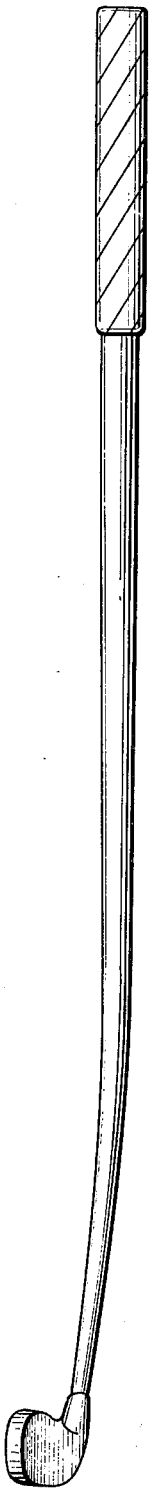

GOLF CLUB SHAFT

BACKGROUND OF THE INVENTION

This invention relates to an improved form of composite golf shaft. In particular, this invention is concerned with a golf shaft having a tubular metallic core having graphite fiber reinforcing layers superimposed thereon.

There are numerous factors which affect the performance characteristics of golf shafts such as weight and balance of the shaft, the flexibility of the shaft and the ability of the shaft to withstand shock. Additionally, of course, a golf shaft of optimum design must maintain its performance characteristics over a wide range of ambient weather conditions, and it should be resistant to moisture and other corrosive elements such as hand perspiration and the like.

In addition to the foregoing considerations, it is well known that there is a somewhat intangible, but nonetheless real and important, characteristic of a golf shaft referred to as the "feel" which has a very definite effect on the playability of the shaft as well as the commercial acceptance of the shaft.

A considerable amount of effort has been expended in the past to produce golf club shafts having the desired performance characteristics. Thus, golf club shafts have been made from wood, such as hickory, and metals, such as steel and aluminum. The wooden shafts have the advantage of not transferring vibrational shocks to the player when the ball is struck during play. On the other hand, the wooden shafts suffer from the disadvantage that they are not easily matched into a complete set. They are very much subject to changes in climatic weather conditions. Metal shafts generally are not susceptible to variations in physical characteristics and response to climatic changes; however, tubular metal golf shafts transfer a great amount of vibration to the player when the club head strikes the golf ball. Attempts have been made to remedy the deficiencies of the tubular golf shafts by coating the metal tube with a resin-impregnated glass fiber. Use of such resin-impregnated glass fiber coatings on tubular shafts, however, has the tendency to provide a dampening effect on the vibrations normally experienced. Nonetheless, such coatings have introduced other changes in the playing characteristics of the club. Indeed, one of the particular difficulties associated with fiber reinforced resin coatings on tubular metal shafts is associated with the significant difference in the physical properties of the two essential materials, i.e. the metal and the glass fiber. To get the requisite performance from the golf shaft, both materials must be combined in such a way as to operate harmoniously in producing the desired result. This has not been readily achieved in the past. Moreover, glass fiber reinforced metal tubes tend to require increased weight to maintain the requisite torsional and bending stiffness. Finally, it is worth noting that durability tends to be a problem when bonding dissimilar materials. Consequently, there still remains need for an improved golf shaft that will have the necessary strength and weight and which will permit the player to attain greater hitting force and control and which can be accurately adjusted to provide a set of matched golf clubs each having the same "feel".

SUMMARY OF THE INVENTION

According to the present invention, an improved golf shaft comprises at least two superimposed strips of sheet material of resin impregnated unidirectional continuous graphite fiber reinforcements in a resin matrix spirally wound on top of a tapered metal tubular shaft, each strip of resin impregnated unidirectional graphite fiber reinforcing material being quadrangular in shape with the fibers oriented substantially parallel to the axis of the quadrangular sheet. The fibers in the alternating strips of sheet material are in opposite angular relationship to the next adjacent strip. A layer of woven fiberglass is interposed between alternating strips of the resin-impregnated graphite fiber reinforcement. A layer of a structural adhesive is interposed between the first layer of resin impregnated unidirectional graphite fiber reinforcement material and the metal core. This structural adhesive is present in a predetermined specified amount effectively providing a buffering zone between two very dissimilar materials. The layers of resin are molecularly bonded one to the other as a result of curing at elevated temperatures.

In one embodiment of the invention, a sheet of resin impregnated unidirectional graphite fiber is circumferentially wound on the tubular shaft in the region where the butt section, in effect, begins to taper downwardly toward the top of the shaft so that the graphite fibers of the sheet material are oriented parallel to the longitudinal axis of the shaft. These longitudinal oriented fibers provide a predetermined bending profile for the shaft which will be explained in greater detail hereinafter.

The method of the present invention basically requires cutting a thin sheet of resin impregnated unidirectional graphite fibers into a predetermined flat pattern. A first layer of structural metal adhesive is applied to the underside of said flat pattern while a piece of fiberglass fabric cut to the same predetermined flat pattern is placed on the upper side of the resin impregnated graphite fiber. The resultant laminated quadrangular sheet is spirally wound around a tapered tubular metal core. Thereafter, a second layer of impregnated graphite fiber sheet material is cut into the same predetermined flat pattern as the first thin sheet of resin impregnated unidirectional graphite fiber. This quadrangular sheet of material is spirally wrapped over the first layer at an angle generally oppositely disposed with respect to the sheet of the first layer. After wrapping the material around the core, i.e. both the spirally wrapped layers and, if applicable, the optional circumferentially wrapped layer, the assembly is heated at temperatures in the range of about 100° to 150° C for 0.5 to 3 hours causing the resin layers in the various convolutions to bond to each other.

Various color and texture variations of the finished shaft are possible by proper use of pigments in the resin materials and by the proper use of paints and other cosmetic techniques well known in the art.

BRIEF DESCRIPTION OF THE DRAWINGS

FIG. 7 is a fragmentary top plan view showing the spiral winding of two sheet materials on a tubular metal core and their relationship to each other in accordance with the present invention.

FIG. 8 is a fragmentary view partially cut away showing the various layers of material employed in the body portion of the preferred golf shaft of the present invention.

FIG. 9 diagrammatically illustrates a sheet of resin impregnated graphite fiber reinforcing material used in one embodiment of the present invention.

FIG. 10 is a diagrammatic fragmentary illustration of the winding of a sheet of resin impregnated continuous graphite fiber material near the butt portion of a golf shaft in one embodiment of the present invention.

FIG. 11 is an exaggerated diagrammatic illustration of the bending profile of a golf club having a shaft in accordance with one embodiment of the present invention.

FIG. 12 is an exaggerated diagrammatic illustration of the bending profile of a golf club having a shaft in accordance with another embodiment of the present invention.

DETAILED DESCRIPTION OF THE INVENTION

Figures 1, 2, 3, 4, 5, 6:
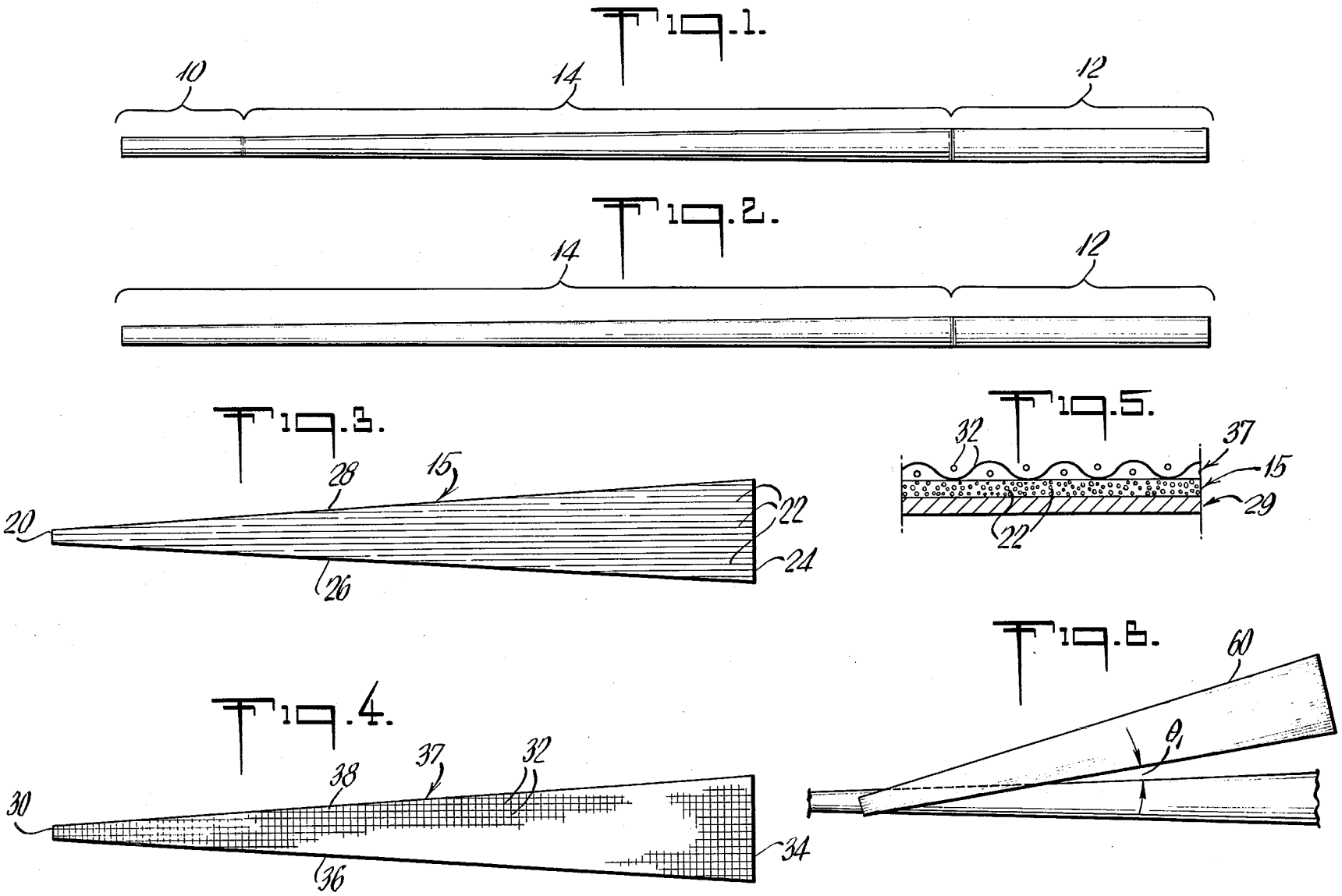
FIG. 1 illustrates in reduced scale a tapered tubular core used in forming the golf shaft of the present invention.
FIG. 2 illustrates in reduced scale an alternate metal tubular core used in forming the golf shaft in accordance with the present invention.
FIG. 3 diagrammatically illustrates a sheet of resin impregnated graphite fiber reinforcing material used in forming the golf shaft of the present invention.
FIG. 4 diagrammatically illustrates a sheet of woven glass cloth used in forming the golf shaft of the present invention.
FIG. 5 is an enlarged fragmentary cross section of an oblong blank of laminated sheet material comprising a structural metal adhesive layer, a graphite fiber resin impregnated layer and a fiberglass cloth layer.
FIG. 6 is a diagrammatic illustration of the winding of an oblong blank of laminated material around the tubular metal core of the shaft of the present invention.

Referring now to the drawings, it should be noted that like reference characters designate corresponding parts throughout the several drawings and views.

The golf shaft of the present invention has a metal core in the form of a generally tapered hollow tube as is shown in FIG. 1. The core of the golf shaft need not be entirely tapered but may, for example, have a generally cylindrical tip section 10 and a cylindrical butt section 12 with a substantially tapered body portion 14. In the embodiment shown in FIG. 2, the butt section 12 of the tubular core is substantially cylindrical; the remainder of the metal core is tapered. Thus, at the tip of the core shown in FIG. 2, the taper of the body section begins immediately and continues from the very tip to the butt section. The butt section 12 is again cylindrical.

Although the tubular metal core is referred to as having separate sections, it should be understood that this metal core is indeed a unitary tubular member and that the sections referred to hereinabove merely refer to general areas along the length of the tube.

In order that the golf shaft will have the requisite strength and weight, it is preferred that the metal tube be fabricated from aluminum or magnesium alloys. Indeed, it is particularly preferred that the core be fabricated from the following aluminum alloys: 7178; 7075; 7049 and 7050. The foregoing numerical designations refer, of course, to U.S. alloy compositions. It is particularlly preferred that these alloys have a T-6 temper. Aluminum alloys having the foregoing compositions and temper are articles of trade readily available and can be shaped into tubular articles by standard techniques.

Typically, the tubular core will be about 46 inches in length and have an outer diameter at the butt end of no greater than about 0.570 inches and no less than about 0.560 inches. Typically, the butt diameter will be 0.570 inches. At the tip end of the metal core the outer diameter of the core will be in the range from about 0.260 to about 0.270 inches and preferably 0.270 inches. The wall thickness of the metal core at the butt end of the core will be in the range of 0.12 to 0.17 inches and preferably 0.17 inches. Both the length of the tip section 10 and butt section 12 will vary depending upon whether the shaft will be used in a wood or iron golf club and depending upon the type of flex desired. Typically, a tip section 10 can range anywhere from one inch to about 8 inches in length and the butt section 12 will range generally anywhere between 12 inches and 16 inches in length.

As mentioned previously, the tubular core is fabricated by well known techniques such as drawing or extruding a heavy walled cylindrical billet to the required dimensions.

In fabricating the composite golf shaft of the present invention, it is important that the metal core be completely clean to avoid any possible contaminants. The final cleaning of the metal generally is made with a material such as an alcohol or chlorofluorocarbon to remove traces of lubricants, grease, etc.

The golf shaft of the present invention has the metal core encased in a sheath of resin impregnated graphite and glass fiber fabric which is bonded to the core so that it is substantially integral therewith. This sheath of resin impregnated fiber material is actually fabricated from various layers of material which are ultimately bonded one to the other by curing of the resin contained therein.

In fabricating the golf shaft of the present invention, an oblong sheet, or gore, such as that shown in FIG. 3 is cut from a sheet of unidirectional graphite fibers impregnated with a plastic resin. As shown in FIG. 3, this gore 15 is cut in a quadrangular form wherein end edges 20 and 24 are parallel to each other but are different lengths. Lengthwise edges 26 and 28 are not parallel but provide a taper as they converge toward end edge 20. The graphite fibers 22 are perpendicular to the end edges 20 and 24. The resin impregnating the graphite fibers 22 is a thermo-setting resin. Suitable thermosetting resin materials include epoxy and polyester resins. Particularly gore 15 would be about 46 inches long and in the range of 1.9 to 2.2 inches at the edge 24 and in the range of 0.9 to 1.1 inches wide at the edge 20. Particularly, also, gore 15 would have a thickness of about 0.007 to 0.01 inches and contain from about 50 to about 60 volume percent of graphite fibers in the thermoset resin matrix. Preferably, the gore 15 used in the present invention has 54–58 volume percent graphite fibers in an epoxy resin matrix.

The epoxy resins are polyepoxides which are well known condensation products or compounds containing oxirane rings with compounds containing hydroxyl groups or active hydrogen atoms such as amines, acids and aldehydes. The most common epoxy resin compounds are those of epichlorohydrin and bis-phenol and its homologs.

The polyester resin is a polycondensation product of polybasic acids with polyhydric alcohols. Typical polyesters include polyterphthalates such as poly(ethylene terphthalate).

As is well known in the art, these thermoset resins include modifying agents such as hardeners and the like. Forming such compositions is not a part of the present invention. Indeed, the preferred modified epoxy resin impregnated graphite fibers are commercially available materials. For example, modified epoxy pre-impregnated graphite fibers are sold under the tradename of Rigidite 5209 and Rigidite 5213 by the Narmco Division of Celanese Corporation, New York, N.Y. Other commercial sources of resin pre-impregnated graphite fibers are known in the industry.

Returning again to the drawings, as can be seen in FIG. 4, a woven glass fabric layer, or gore, designated generally by reference 37 is provided. This gore 37 has the same dimensions as gore 15. In other words, end edges 30 and 34 are parallel to each other but are different lengths, whereas side edges 36 and 38 are not parallel and provide a taper as they converge toward end edge 30. This gore 37 will have a thickness of about 0.001 to about 0.002 inches and will consist of woven glass fabric, preferably a fiberglass fabric known in the trade as fiberglass scrim is used. An especially useful fiberglass scrim is style 107 sold by Burlington Glass Fabrics Company, New York. As can be seen, the fibers 32 of the woven fiberglass fabric are at angles of 0° and 90° with respect to end edges 30 and 34.

In fabricating the shaft, the layers of gores 15 and 37 are cut from stock material to the desired flat pattern. Each layer is cut to the same size and shape. Layer 37 is placed on top of gore 15. The underside of gore 15, as shown in FIG. 5, is provided a layer of structural metal adhesive 29. The metal adhesive is a material employed for bonding plastics to metal such as elastomeric modified epoxy and elastomeric modified phenol-urea type resins. One example of one type of adhesive is a polysulfide elastomer modified epichlorohydrin-bis-phenol resin. Many structural adhesives are commercially available, one of which is known as Metlbond 1133 which is an elastomer modified epoxy material sold by the Narmco Division of Celanese Corporation, New York, N.Y.; another is FM 123-2 sold by American Cyanamid Co., Wayne, N.J. The structural metal adhesive is applied to the underside of gore 15 by means of brushing or spraying, for example, when the physical consistency of the adhesive so permits, so as to cover the entire bottom surface of the gore 15. When the adhesive is a thin film sheet material, the gore can very simply be placed on top of the adhesive film. In any event, a first oblong layer of laminated sheet material is provided and, as shown in FIG. 5, is composed of structural adhesive 29, a layer of continuous graphite fiber in a resin matrix 15 and a woven fiberglass layer 37.

Conveniently, when the structural metal adhesive is in the form of a thin film of sheet material, a stock laminate of structural adhesive, resin impregnated graphite fibers and glass scrim can be made and the laminate cut to the dimensions of gore 15.

It is especially important in the practice of the present invention that the weight of structural metal adhesive layer employed be kept in the range of about 0.027 to 0.033 pounds per square foot; and, indeed, it is particularly preferred that the weight of the adhesive layer 29 to be about 0.03 pounds per square foot. Experience has shown in attempting to fabricate suitable golf shafts that the resultant shaft will not be able to handle the strains to which it is subjected during strenuous play if less than 0.027 pounds per square foot of adhesive is employed. On the other hand, if more than 0.033 pounds per square foot of adhesive is employed, the shaft loses the desired degree of flexibility. Moreover, the requisite amount of adhesive enhances durability of the shaft of the present invention. Finally, while not wishing to be bound by any theory, it should be noted that the graphite fiber reinforcing material and the metal core have vastly different coefficients of expansion which must be in some way able to perform with each other as a single unit. Apparently, the amount of adhesive that is applied is most important in assuring not only the proper bonding of the plastic resin to the metal but assuring the cooperation of the torsional rigidity of the metal tubing with the longitudinal stiffness of the graphite fiber reinforcement.

In any event, the oblong laminated material consisting of structural adhesive 29, resin impregnated graphite fiber layer 15 and glass fabric layer 37 is spirally wound as a single laminated layer 60 as is shown in FIG. 6 around the tubular metal core. It should be noted that the adhesive layer is placed in contact with the tubular metal core and that the laminate 60 is so arranged with respect to the longitudinal axis of the metal core that the continuous graphite fibers can be considered to be arranged at an angle varying generally between 5° and 15° with respect to the longitudinal axis. This angle of orientation is shown as $\theta_1$ in FIG. 6.

A second oblong sheet of resin impregnated graphite fiber material is cut having the same dimensions as gore 15. This second sheet is shown in FIG. 7 by reference 51. As is shown in FIG. 7, the second graphite fiber layer 51 is wrapped in a spiral direction around the metal core so as to overlap the first laminated layer 60. More particularly, it should be noted that the second graphite fiber layer 51 is wrapped spirally at an angle oppositely disposed with respect to the fibers in the first layer. This relationship is also brought out in FIG. 8 wherein the first layer 11 shown therein is the metal tubular core upon which is next shown layer 29 of structural metal adhesive followed by layer 15 in which the graphite fibers 22 form an angle shown as $\theta_2$ with respect to the longitudinal axis of the metal tube. $\theta_2$ is generally in the range of 5° to 15°. The next layer 37 consists of woven glass fabric. The fibers 32 can be seen to be at 0° and 90° with respect to the longitudinal axis. Finally, the top layer 51 of graphite fiber reinforced resin has graphite fibers 22 which as a result of winding form an angle $\theta_3$ ranging from $-5°$ to about $-15°$. In all instances, the magnitude of $\theta_2$ and $\theta_3$ are the same and they are merely opposite in sign.

In wrapping the laminate 60 around the metal tubular core, it is particularly preferred that there by very little overlap. Indeed, it is most preferred if each spiral wrapping abutt against the preceding spiral wrapping. However, an overlap of about 1/16 inch can be tolerated. This is also true in the spiral wrapping of layer 51.

Optionally, prior to spirally wrapping the layer 51 on the shaft, a layer of resin impregnated unidirectional graphite fiber sheet material is circumferentially wound on the shaft in the region where the butt section meets the tapered body section so that the unidirectional fibers are oriented at an angle of 0° with respect to the longitudinal axis of the shaft. Thereafter layer 51 is spirally wound on the shaft as described above.

As can be seen in FIG. 9, this butt insert has unidirectional continuous graphite fibers 92 that are parallel to the lengthwise edge 98. The end 94 of the butt insert is not straight but rather sawtoothed. This is most important in avoiding an abrupt change in the bending profile of a shaft including such an insert. The length of this butt insert is in the range of about 8 to 12 inches and the width is equal to the circumference of the tube to be wrapped with the butt insert. This butt insert can be cut of the same material as gore 15. If an appropriate pinking shears is employed in making the end cuts, the requisite sawtooth pattern will be obtained. The preferred height of the teeth is about 1 inch. As shown in FIG. 10, the butt insert is positioned and circumferentially wrapped around the tubular core so that the graphite fibers 98 are oriented at 0° with respect to the longitudinal axis of the shaft.

After winding laminated layer 60, optional butt insert if applicable, and graphite fiber reinforced layer 51 around the core, these materials can be held in place by means of cellophane tape, for example. Alternatively, the assembly of core and external plastic impregnated fiber reinforcing material can be held in place by a wrapping of a polypropylene heat shrinkable film (not shown) which serves, in effect, as a mold and which is subsequently removed as hereinafter described.

After wrapping the metal core with the requisite layers of material, the assembly is placed in an oven and heated to a temperature sufficient to cause a bonding of the separate layers and the various convolutions to each other. The temperature at which the assembly is heated depends upon a number of factors including the resin which is used to impregnate the graphite fibers. These temperatures are well known. Typically, for modified epoxy resin impregnated graphite fiber the temperature will be in the range of about 100° C to about 180° C and preferably from about 140° C.

If an external polypropylene wrapping film is used to hold the various layers around the metal core, this is removed very simply by manually peeling it away from the surface of the shaft.

Surface imperfections, if there are any, on the shaft can be removed by sanding and grinding or the like. Finally, the shaft can be fitted with a grip and club head. Optionally, the shaft can, prior to being fitted with the grip and club head, be painted to provide the desired color appearance.

Continuous unidirectional graphite material generally displays very low stretch or elongation factors compared with tubular metal materials such as aluminum and steel and the like. The composite shaft of the present invention as a result of the inclusion of graphite fibers and the particular angle of orientation referred to herein has exceptional recovery. In other words, when the golf club is swung on a backswing, the shaft tends to bend backwards, and, on the downswing, the club head is behind the hands of the hitting area. Then the shaft begins to restore itself and the club accelerates into the hitting area. This is generally referred to as the "club head recovery." Because the graphite fibers in the shaft of the present invention have a low stretch or elongation factor compared with conventional shaft materials, the shaft restores itself at a much higher rate. This results in a higher club head speed at impact. Moreover, the club head does not slow down significantly after impact. This increase in club head speed means more energy at impact and that means more carry on drives. The composite shaft of the present invention, however, also has a metal tubular core which provides the torsional rigidity. Thus, lateral shot dispersions for numerous players are substantially reduced by virtue of the metal tubular core. Significantly, the graphite fibers in the core by virtue of the structural metal adhesive interposed between these materials perform cooperatively rather than independently, thereby providing for vast improvement in the subject golf shaft.

Another significant feature of the shaft of the present invention is the significant stiffness provided at relatively low weight. A golf club employing a shaft of the present invention will have a total weight lower than any other commercially available golf club of the same head size. Moreover, for a given head size a golf club with the shaft of this invention has a lower center of gravity, thereby placing the mass in the hitting zone. Thus, for a given swing speed there is more energy, for greater drives.

Referring now to FIG. 11, an exaggerated bending profile of a golf club having a shaft of the present invention, without the butt insert, is shown. As can be seen, the bending profile of this shaft begins much higher along the length of the shaft. In contrast thereto, a golf club which has a shaft of the present invention which includes a butt insert has a bending profile, as shown in FIG. 12, beginning much lower along the length of the shaft. It has been found that an average player having a relatively slow swing can improve his game by using a shaft having a butt insert in accordance with the present invention whereas a player with a stronger swing is more suited to a golf shaft having the higher bending profile.

What is claimed is:

1. A graphite fiber reinforced tubular golf shaft having a tip section, body section and butt section and comprising: at least two superimposed strips of resin impregnated unidirectional continuous graphite fiber reinforcements spirally wound on a hollow metal core, each strip of resin impregnated graphite fiber material being generally quadrangular in shape, each strip disposed in an oppositely angled relationship with respect to the next adjacent strip such that the graphite fibers are oriented with respect to the longitudinal axis of the metal core at angles of ±5° to ±15°; a layer of woven fiberglass cloth interposed between alternating layers of superimposed strips of resin impregnated graphite fiber reinforcement, said woven fiberglass cloth being positioned such that the glass fibers therein are oriented at 0° and 90° with respect to the longitudinal axis of the tubular metal core; a layer of structural metal adhesive interposed between said core and said resin impregnated unidirectional graphite fiber strips, said superimposed resin impregnated graphite fiber strips being molecularly bonded to each other and to the metal core by thermal curing of said resin and adhesive.

2. The shaft of claim 1 wherein the resin is a thermoset resin.

3. The shaft of claim 2 wherein the metal core is selected from the group consisting of alloys of aluminum and magnesium.

4. The shaft of claim 2 wherein there is included a sheet of resin impregnated graphite fibers circumferentially wound in the region where the butt section begins to taper downwardly to the tip of the shaft and so that the fibers are oriented at 0° with respect to the longitudinal axis of the shaft.

5. The shaft of claim 3 wherein the metal core is an aluminum alloy.

6. The shaft of claim 5 wherein said structural metal adhesive is present in an amount ranging from about 0.027 to about 0.033 lbs/ft$^2$.

7. The shaft of claim 6 wherein the sheet of resin impregnated graphite fiber which is circumferentially wound in the region where the butt section begins to taper downwardly to the tip of the shaft has end edges that have a saw-tooth profile.

8. A graphite fiber reinforced tubular golf shaft having a tip section, a body section and a butt section, said shaft comprising: a central tapered hollow aluminum-alloy metal core and a sheath of at least two plies of continuous unidirectional graphite fiber reinforcement in a thermoset resin matrix, said thermoset resin matrix being bonded to said aluminum core by means of an intermediate layer of structural metal adhesive in an amount in the range of 0.027 to 0.033 pounds per square foot, said fibers of said plies being oriented in opposite angular relationships with each other and at an angle of 5° to 15° with respect to the longitudinal axis of the shaft, said graphite fiber reinforced plies having interposed therebetween a layer of fiberglass scrim, the fibers of said fiberglass scrim being at 0° and 90° with respect to the longitudinal axis of the shaft.

9. The shaft of claim 8 wherein there is included a sheet of resin impregnated graphite fibers circumferentially wound in the region where the butt section meets the body section of said shaft and so that the fibers are oriented at 0° with respect to the longitudinal axis of the shaft.

10. The shaft of claim 9 wherein the sheet of resin impregnated graphite fiber which is circumferentially wound in the region where the butt section begins to taper downwardly to the tip of the shaft has end edges that have a saw-tooth profile.

* * * * *